United States Patent [19]

Hand

[11] 4,248,463

[45] Feb. 3, 1981

[54] SECURITY SYSTEM

[76] Inventor: William Hand, 805 Mackinaw Ave., Calumet City, Ill. 60409

[21] Appl. No.: 938,449

[22] Filed: Aug. 31, 1978

[51] Int. Cl.[3] ..... E05C 13/10

[52] U.S. Cl. ..... 292/340

[58] Field of Search ..... 292/1, 144, 201, 340, 292/341.15, 341.16; 70/262, 432, 438

[56] References Cited

U.S. PATENT DOCUMENTS 1,097,154 5/1914 Wright ..... 292/341 A X 3,354,677 11/1967 Green ..... 292/341.16 X

*Primary Examiner*—Richard E. Moore

*Attorney, Agent, or Firm*—James R. Haller

[57] ABSTRACT

A security system for hotels, motels, and the like in which a dead bolt door lock must be in the locked position to enable electric accessories or devices such as lights or television sets to be utilized. The security system includes sensing and control means for sensing the position of the dead bolt lock and for responsibly enabling or disenabling the electric circuitry.

8 Claims, 3 Drawing Figures

SECURITY SYSTEM

BACKGROUND OF THE INVENTION

In an effort to promote the security of occupants of hotel and motel rooms and the like, dead bolt locks are commonly provided on the doors of such rooms. In addition to dead bolt locks, such doors are usually provided also with common latch locks. Unfortunately, and perhaps because of forgetfulness or other reasons, the occupants of rooms often do not bother to lock the dead bolt locks. The common latch locks can rather easily be defeated, and in the absence of locked dead bolts, a motel or hotel room becomes easy prey for burglars.

I have contemplated several ways of solving this problem. One of these ways has involved the use of an automatic dead bolt lock which would be electrically powered (as through a solenoid), and which would automatically be moved to the locked position in response to the turning on of an interior light or television set or the like. The drawbacks of this solution are manifold, of course, perhaps the more important drawback being the potential failure of the dead bolt transport mechanism which could result in one being effectively locked in one's room. Also, the room occupant would thus lose his freedom of choice as to whether the door should be locked or unlocked with a dead bolt lock.

A security system which would avoid the potential problem of malfunctioning of an automatic dead bolt lock, which would preserve freedom of choice for the occupant as to whether a door should be locked with a dead bolt or not, but which would none the less strongly encourage occupants of hotels or motels to lock their room doors with dead bolts from the inside, would be highly beneficial.

SUMMARY OF THE INVENTION

My invention relates to a security system for hotels, motels, and the like to encourage occupants to lock their room doors behind them with dead bolt locks. Broadly, the system includes a dead bolt lock for locking the door, and sensing and control means for sensing whether the dead bolt lock is in its locked or unlocked position and for responsively enabling or disenabling electric circuitry powering such items as television sets, room lights, etc. In this manner, such non-essential electric devices as television sets and the like to not operate unless the dead bolt lock has been manually moved to its locked position.

The sensing and control means desirably comprises a lock switch means so constructed and arranged as to be operated by the dead bolt lock, and relay means operated by the lock switch means and connected into electric circuitry for television sets and the like in a room. The lock switch means and relay means coact to cause the relay means to energize room circuitry in response to manual locking of the dead bolt lock. When the latter is manually unlocked, the relay means disenables the room circuitry.

Override means may be provided to maintain the relay means in a condition to enable or energize the room circuitry regardless of the position of the dead bolt lock. Desirably, the override means includes a key-operated switch for short-circuiting or otherwise overriding the lock switch means.

The security system may be installed to control the entire circuitry of a room, but preferably controls only such circuitry as that powering such non-essential electric devices as television sets, bedside or interior lamps and the like so that circuits for more essential devices such as air conditioners, heaters and clocks remain energized even when the dead bolt lock is in its open position.

DESCRIPTION OF THE PREFERRED EMBODIMENT

Figure 1:
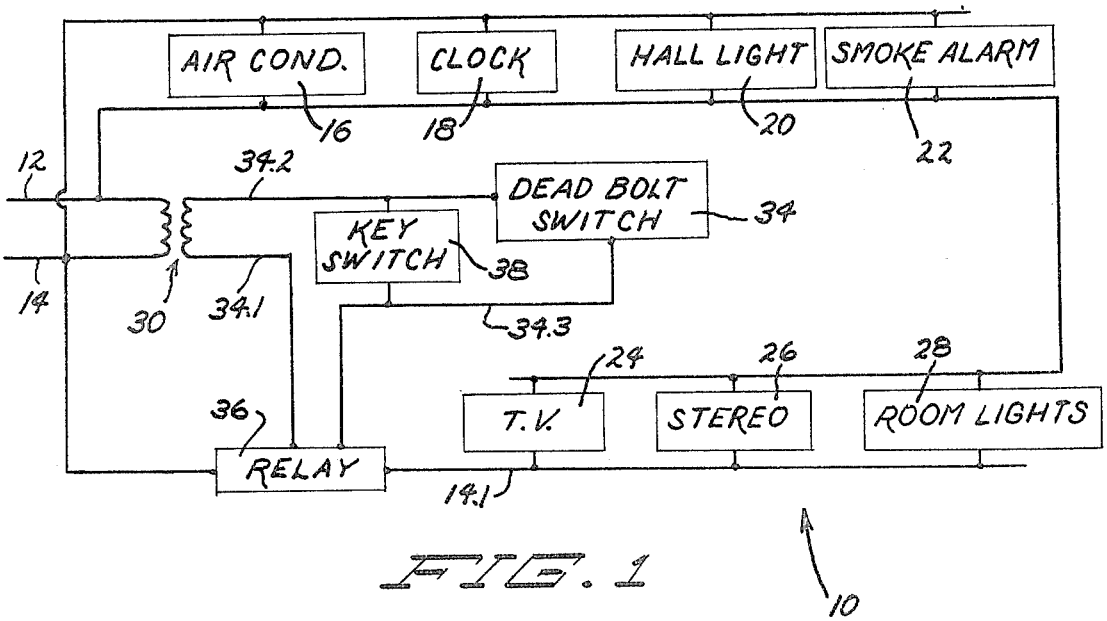
FIG. 1 is a representation of one form of the invention in schematic form.
Figure 2:
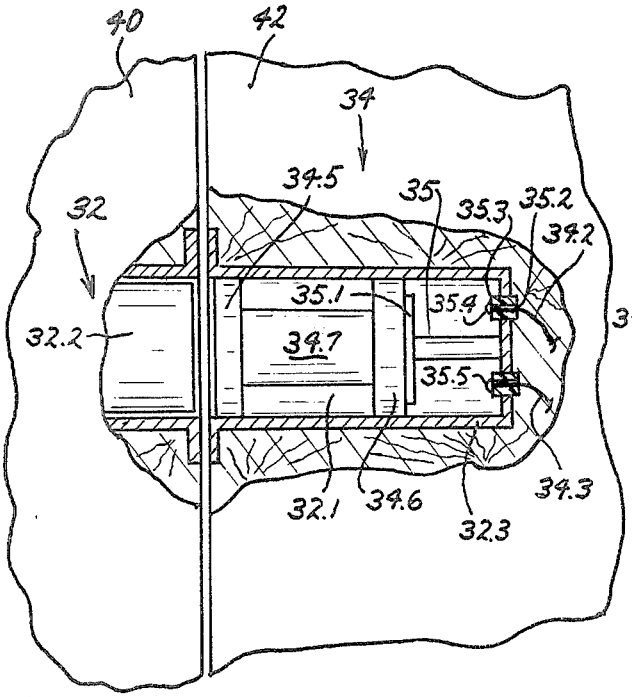
FIG. 2 is a broken away, cross sectional view of a lock switch useful in the instant invention.

With reference to FIG. 1, the circuitry of a motel room or the like including the instant invention is designated generally as 10. As shown, 110 volt AC current is provided by leads 12, 14, lead 14 being the so called "hot" lead. The leads 12 and 14 are connected, through the use of common wall plugs and switches and the like, to representative electrical devices such as an air conditioner 16, a clock 18, a hall light 20 near the doorway, and a smoke alarm 22. The above devices ordinarily are energized continuously regardless of whether the doors to the room are open or shut, or locked or unlocked, and electric devices of this type are hereinafter referred to "essential" devices. The leads 12, 14 also carry electricity to power such non-essential devices as a television set 24, a stereo player 26, and interior room lights 28 such as beside lamps. As noted, devices of this type are herein referred to as "non-essential" in that they are largely convenience devices. It will be understood, however, that even these devices are heavily used. Again, the leads 12, 14 ordinarily lead to wall receptacles into which the latter devices are plugged.

As will be described in greater detail below, the door of the room is provided with dead bolt means such as dead bolt 32 which is manually operable from the interior of the room to securly lock the door. Dead bolt switch means such as switch 34 is mounted in the receptacle 32.1 carried by the door jamb, and is closed and opened as the dead bolt is moved, respectively, into its locked and unlocked positions. The leads 12, 14 are connected to a step-down transformer 30 to deliver a reduced voltage, eg., 24 volts, across leads 34.1, 34.2. Lead 34.1 is connected to relay means such as electric relay 36, and lead 34.2 is connected to the dead bolt switch 34. Another lead 34.3 connects the other side of the dead bolt switch to the relay 36.

The relay 36 is connected into the "hot" lead 14 which is employed to operate, through lead 14.1, the non-essential electric devices. The relay may take the form of a simple solenoid which is energized by a current flowing through the leads 34.1, 34.3 so as to transmit current from the lead 14 to the lead 14.1. A great many relays of this type are known to the art, and the relay 36 need not be described in greater detail here.

If desired, override means may be employed to close the relay 36 even though the dead bolt switch is open. In FIG. 1, an override means is exemplified as key switch 38 which is connected across leads 34.2 and 34.3 so as to short-circuit the dead bolt switch 34. As will be described in greater detail below, it is contemplated that the switch 38 can be operated only through use of a particular key.

Figure 3:
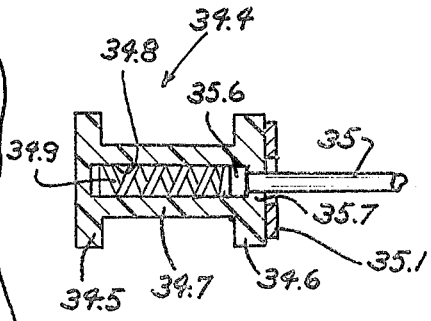
FIG. 3 is a cross sectional view of a portion of the lock switch shown in FIG. 2.

In FIG. 3, the door and the adjacent door jamb are designated as 40 and 42. The dead bolt lock 32 is installed in the door in the usual manner, and includes a dead bolt 32.2 which is adapted to be manually moved outwardly into a bolt receptacle or socket 32.1 mounted in the door jamb, all in the usual fashion. It will be understood that the dead bolt locks of the type described often are operated by turning a small handle (not shown) on the door, although some dead bolts are key operated, as is also known.

The dead bolt switch 34 is mounted within the receptacle 32.1, and includes a plastic plunger 34.4 having a configuration adapted to slide back and forth whithin the receptacle. The plunger 34.4 includes an outer section 34.5 which is adapted to be struck by the end of the dead bolt 32.2 when the latter is moved into its locked position. The receptacle 32.1 may be provided with a metal case 32.3 of a cylindrical or generally rectangular cross section within which the plunger 34.4 moves. The plunger includes a thickened section 34.6 at its inner end, and a central body portion 34.7 joining the ends 34.5, 34.6. The end portions are provided with a circumferential configuration closely matching the cross section of the receptacle 32.1 so that the plunger can slide smoothly within the receptacle without binding. The plunger is provided with an internal bore 34.8 which is closed at its outer end. A helical compression spring 34.9 is carried in the bore. A guide 35 is positioned in the bore so that its outer end comes into contact with the spring 34.9 and its inner end is attached to the inner end wall of the receptacle casing 32.3. In this manner, the spring and pin coact to urge the plunger 34.4 outwardly of the receptacle, and the plunger is moved inwardly against the force of the spring by movement of the dead bolt 32.3 into the receptacle. The inner face of the plunger is provided with an electrically conductive plate 35.1 which is desirably sized to avoid contact with the receptacle case 32.3 and with the pin 35. The end wall of the receptacle case is provided with the lead wire openings (of which one is designated 35.2), and the openings may be provided with insulating sleeves 35.3 through which pass the leads 34.2, 34.3. The last-mentioned leads terminate interiorly of the receptacle in contact points 35.4, 35.5 which are brought into contact with the plate 35.1 when the plunger is moved inwardly of the receptacle by the dead bolt 32.2, the plate 35.1 thereby completing the electric circuit between the leads.

It will be noted that the thus described dead bolt lock switch 34 is controlled by, but does not control, the dead bolt 32.2. In the event that the switch should fail due to binding or sticking of the plunger 34.4, the dead bolt 32.2 can easily be withdrawn manually from the receptacle. It will also be understood that the guide pin 35 may be provided with an enlarged outer end portion 35.6 which has sholders abutting sholders 35.7 on the inner circumference of the bore at the inner end of the plunger 34.4, thereby retaining the end of the pin in the bore and preventing the plunger from escaping outwardly of the casing 32.3.

A variety of other switch designs which can be operated by movement of a dead bolt 32.2 will now be evident to those skilled in the art. The above-described switch is mounted within the receptacle for the dead bolt, but other switches may be mounted, for example, to the side of the jamb. Further, although the above-described switch is closed when the dead bolt is within the receptacle, it may be desirable to design the switch so that it is in its open position instead when the dead bolt is locked.

In operation, the "essential" electric devices are connected directly across the incoming electrical leads 12, 14 and thus are continuously energized. The "non-essential" devices, however, are energized only when the relay 36 is closed. This relay, in turn, is controlled by the dead bolt switch 34 such that the relay is in its conducting or "on" position when the dead bolt switch 34 signals that the dead bolt lock is locked. In this manner, it will be understood that the "non-essential" electrical accessories or devices within the room can be turned on and operated only when the dead bolt lock has been locked, and an occupant of the hotel or motel room is thus encouraged to lock the door of his room.

Since hotel and motel rooms are often the scene of parties or meetings, for which it would be inconvenient to maintain the dead bolt lock in its locked position in order to operate interior lights and the like, it may be desirable to provide override means such as the key switch 38 in the security circuit. FIG. 1 of the drawing depicts the key switch as being connected across the leads 34.2, 34.3 to, in effect, short-circuit the dead bolt switch 34 so that the relay 36 is continuously operated and the lead 14.1 is continuously energized to power "non-essential" devices. I contemplate that the key needed for operation of the key switch may be obtained only from the office of the motel or hotel after due warning is given by the management of the establishment and, perhaps, a release of responsibility has been executed by the occupant. Switches which operate with keys are well known to the art, and need not be described in detail.

The circuit described above contemplates that the relay 36 will be "on" when the dead bolt switch 34 is energized through locking of the door with a dead bolt lock. This circuitry contemplates that a continuous current will be passed through the dead bolt switch in order to maintain the relay in its "on" position. As also noted above, the circuitry may be rewired so that the relay is placed in its "on" position when the dead bolt switch 34 is opened instead, thereby providing savings in power needed to operate the switch.

Further, the above-described circuitry contemplates a single relay which is in line with the lead powering each of the non-essential devices. Since the existing wiring of hotel or motel rooms may employ several incoming circuits, it may be desirable to provide more than one relay so that each of the circuits powering non-essential devices can be controlled in the manner described above.

In order to simplify installation of the security system of the present invention, and to avoid disfiguring walls of a room in order to implant the circuitry, I prefer that the relatively low-voltage circuitry involving the dead bolt switch and relay be mounted in or closely ajacent to the wall socket electrical outlets, and that the wiring for same be disposed interiorly of the room. Leads of this type can be easily attached by known means, for example, along wall boards, door moldings, and the like. Thus, in one embodiment, the leads 34.2, 34.3 from the dead bolt switch 34 may exit from the door jamb in the vicinity of the switch, and may then follow the door jamb molding downwardly and thence horizontally across decorative trim at the bottom of the walls or along the junction of the carpeting and walls to the desired wall outlet, and there wired to the relay 36.

Thus, manifestly, I have provided a security system for hotel or motel rooms which strongly encourages occupants of such rooms to lock their doors with dead bolt locks, but which none-the-less provides the occupants with a freedom of choice regarding the locking of their doors. My system can be easily and inexpensively manufactured, and can be installed without significant disruption or disfigurement of the existing room structure.

While I have described a preferred embodiment of the present invention, it should be understood that various changes, adaptations and modifications may be made therein without departing from the spirit of the invention and the scope of the appended claims.

I claim:

1. A security system for encouraging an occupant of a motel or hotel room or the like equipped with a deadbolt lock to lock the room door with the deadbolt, and comprising relay means for selectively enabling or disenabling electric circuitry in the room, and sensing and control means for sensing whether a deadbolt is in its unlocked position and responsibly controlling the relay means to disenable the circuitry when the deadbolt is in the unlocked position.

2. The security system of claim 1 wherein the sensing and control means comprises lock switch means operated by movement of the dead bolt lock into and out of its locked position, and electrical circuit means electrically connecting the lock switch means with the relay.

3. The security system of claim 2 wherein the lock switch means has open and closed positions, and wherein the relay means disenables room circuitry when the lock switch means is in its closed position.

4. The security system of claim 2 wherein the lock switch means has open and closed positions, and wherein the relay means disenables room circuitry when the lock switch means is in its open position.

5. The security system of claim 1 useful in rooms having a plurality of circuits powering essential and non-essential devices, and wherein the relay means selectively enables and disenables only the circuitry for non-essential devices.

6. The security system of claim 5 useful in hotel or motel rooms or the like wherein the circuits powering non-essential devices include electrical wall receptacles into which the non-essential devices are plugged, the relay means for at least one of such circuits being inserted therein in the vicinity of its respective wall plug, and the system including electric leads disposed interiorly of the room and connecting the lock switch means and relay means, whereby installation of the system can be effected without significant damage to walls of the room.

7. The security system of claim 2 including override means for overriding said lock switch means and controlling the relay means to enable the circuitry regardless of the position of the dead bolt lock.

8. In a moltel or hotel room or the like equipped with a dead bolt lock and at least one electric circuit powering a non-essential electric device such as a television set, a security system for encouraging an occupant of the room to lock the door of the room with the dead bolt, the system comprising a lock switch operated by movement of the dead bolt lock into and out of its locked position, and relay means connected into the circuit for enabling and disenabling the circuit, the relay means being responsive to the position of the lock switch to disenable the electric circuit when the dead bolt lock is in its unlocked position.

* * * * *